US005855702A

United States Patent [19]

Disch et al.

[11] Patent Number: 5,855,702

[45] Date of Patent: Jan. 5, 1999

[54] METHOD AND APPARATUS FOR QUENCHING WORKPIECES

[75] Inventors: Guenther Disch, Gerlingen; Dieter Haag, Affalterbach, both of Germany

[73] Assignee: Aldaichelin GmbH, Korntal-Muenchingen, Germany

[21] Appl. No.: 683,097

[22] Filed: Jul. 16, 1996

Related U.S. Application Data

[63] Continuation-in-parts of PCT/EP95/00083, filed Jan. 11, 1995.

[51] Int. Cl.[6] ..... C21D 1/667; C21D 1/18

[52] U.S. Cl. ..... 148/658; 266/114

[58] Field of Search ..... 148/658; 266/130, 266/259, 114

[56] References Cited

U.S. PATENT DOCUMENTS

| | | | |
|---|---|---|---|
| 3,069,091 | 12/1962 | Glesse | 239/77 |
| 3,909,315 | 9/1975 | Akayama et al. | 148/658 |
| 4,047,985 | 9/1977 | Greenberger | 266/114 |
| 4,415,381 | 11/1983 | Tani et al. | 148/658 |

FOREIGN PATENT DOCUMENTS

| | | |
|---|---|---|
| 2143536 | 9/1970 | Germany . |
| 4218126 | 12/1993 | Germany . |
| 2024871 | 1/1980 | United Kingdom . |

*Primary Examiner*—Deborah Yee

*Attorney, Agent, or Firm*—Kokjer, Kircher, Bowman & Johnson

[57] ABSTRACT

A method and an apparatus are disclosed for quenching workpieces. The workpieces are exposed to a flow of a quenchant fluid. The flow is reversed in its direction. The workpieces are moved through the flow along an axis being essentially transversely to the axis of fluid flow. The workpieces are also reversingly moved.

16 Claims, 3 Drawing Sheets

METHOD AND APPARATUS FOR QUENCHING WORKPIECES

This application is a CIP of PCT/EP95/00083 filed Jan. 11, 1995.

FIELD OF THE INVENTION

The present invention relates to the field of heat treatment of metallic workpieces. Still more specifically, the invention relates to a method and an apparatus for quenching such workpieces.

BACKGROUND OF THE INVENTION

In conventional systems for quenching workpieces, as described for example in German Patent Specification 42 18 126, the workpieces are conveyed through a quenching apparatus on a horizontally extending roller conveyor. On their path through the apparatus the workpieces have applied to them from the underside, in an arrangement designed like a steeping pot, a quenchant that flows as a liquid against the workpieces from below, flows through the gaps between the workpieces, and is then carried off upward and to the side. A corresponding pump device that allows a flow of the liquid quenchant from below is provided for these purposes.

An apparatus for achieving uniform cooling in a hardening bath is known disclosed in German Published Patent Application 21 43 536. The known apparatus comprises a vessel with coolant liquid. A conveyor belt equipped with holes is arranged in the hardening bath. The workpieces pass via a conveyor trough, under their own weight, onto the conveyor belt, are conveyed thereon initially in a horizontal direction, and are then transported obliquely upward via a rising section, out of the bath, to a delivery end.

Propellers with pivotable blades are arranged in the hardening bath. The propellers are controlled by means of a timing relay in such a way that the direction of incidence of the propeller blades changes, for example, every 5 seconds. As a result, the flow direction of the coolant liquid flow passing vertically through the conveyor belt is reversed each time, so that the coolant liquid flows alternately from top to bottom, and from bottom to top, through the conveyor belt.

The known apparatus has the disadvantage that the merely perforated conveyor belt, with its uniform motion in only one direction, results in perceptible shadowing. Consequently the workpieces to be cooled experience an inhomogeneous incident flow despite the cooling flow which reverses in the vertical direction, since portions of the workpieces are shadowed by the remaining webs in the conveyor belt. This leads to distortion phenomena on the workpieces, which are intolerable for many workpieces.

It is therefore the object of the invention to develop a method and an apparatus of the aforesaid kind in such a way that the quenching effect is further improved, and that the workpieces can be quenched without distortion.

SUMMARY OF THE INVENTION

For solving the above-mentioned objects, the invention encompasses a method for quenching workpieces comprising the steps of:

- generating a flow of a quenchant fluid, the flow having a direction along a first axis;
- cyclically inverting the direction of the flow along the first axis;
- exposing the workpieces to the flow with the workpieces being moved through the flow in a direction along a second axis arranged essentially transversely to the first axis; and
- cyclically inverting the direction of the workpiece movement along the second axis.

The invention, further, encompasses an apparatus for quenching workpieces comprising:

- means for generating a flow of a quenchant fluid, the flow having a direction along a first axis;
- means for cyclically inverting the direction of the flow along the first axis;
- means for exposing the workpieces to the flow with the workpieces being moved through the flow in a direction along a second axis arranged essentially transversely to the first axis; and
- means for cyclically inverting the direction of the workpiece movement along the second axis.

Specifically, in contrast to the apparatus according to German Published Patent Application 21 43 536, shadowing on the workpieces is entirely eliminated by the fact that a horizontally reversing motion of the workpieces is superimposed on the vertically reversing motion of the coolant. In addition, the workpieces are located on a roller train with which they have only line or point contact. Flow therefore occurs around the workpieces in a double back-and-forth motion; because a minimal surface of the workpieces rests on the roller train, no shadowing at all can occur on the workpieces. In this manner a articular intimate contact is achieved between workpieces and quenchant, so that all regions of the workpieces come into contact with the quenchant in the briefest possible time.

Practical experiments have shown that the quenching effect and freedom from distortion of the workpieces can be substantially increased in this manner.

A further increase in quenching effect and freedom from distortion can, according to an exemplified embodiment of the invention, be achieved by the fact that the rollers are equipped with constrictions in such a way that the workpieces rest only on circumferential knife-edges of the rollers. The workpieces are thus supported only with point contact.

An improved quenching effect in the support region of the workpieces, as compared with conventional devices, is achieved in this manner. The freedom from distortion of the workpieces is thus further increased.

In preferred embodiments of the method according to the invention, the quenchant is a liquid or a mixture of a liquid and a gas. The gas can be air or an inert gas. In the latter case any change in the surface finish of the workpieces is avoided.

The liquid is preferably water, but can also be another common quenching liquid. The use of a corrosion protection agent is particularly preferred, since this prevents the surface of the workpieces from immediately oxidizing while they are still hot.

When a mixture of liquid and water is used, it is preferred if the mixture is formulated with a liquid content of between 1 and 250 liters per square meter of workpiece surface per minute, at a velocity of from 10 to 30 m per second.

In practical experiments conducted with the method and apparatus according to the invention, it was found that the quenching effect could be substantially improved. It was moreover noteworthy that workpieces could be hardened with minimal distortion. This is particularly important for certain workpieces, for example rolling bearings, in which optimum distortion results have a direct and considerable economic effect. The invention is therefore applicable with particular advantage to this type of workpiece.

Further examples are evident from the drawings and the attached description.

It is understood that the features mentioned above and those yet to be explained below can be used not only in the respective combinations indicated, but also in other combinations or in isolation, without leaving the context of the present invention.

BRIEF DESCRIPTION OF THE DRAWING

Embodiments of the invention are depicted in the drawings and will be explained in more detail in the description below. In the drawings.

DETAILED DESCRIPTION OF THE PREFERRED EMBODIMENTS

Figure 1:
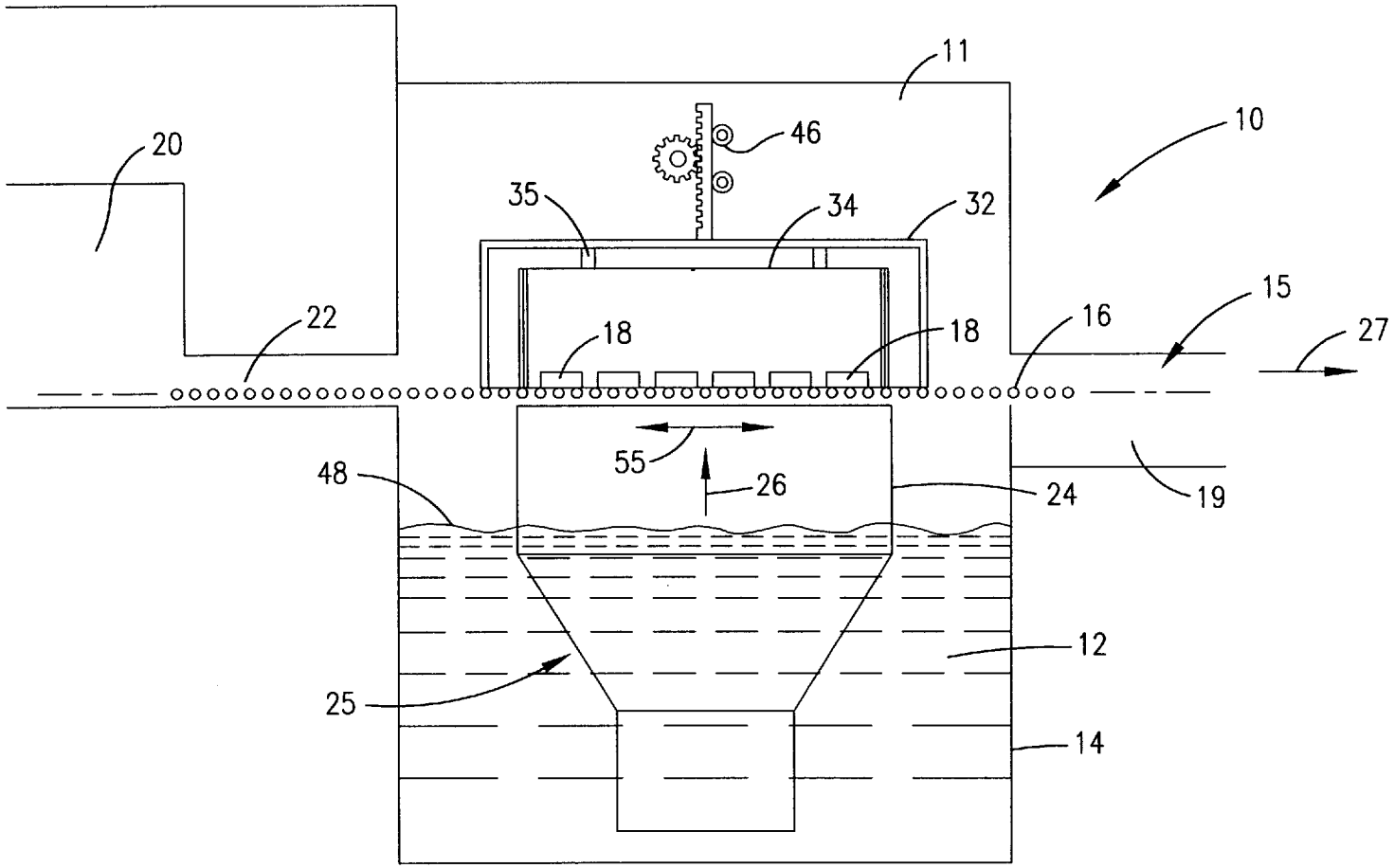
FIG. 1 shows a first exemplified embodiment of an apparatus according to the invention, in side view and highly schematized.

In FIG. 1, a first exemplified embodiment of an apparatus according to the invention for quenching workpieces is designated overall as 10. Quenching apparatus 10 is connected to a upstream annealing furnace via a relative narrow opening 22.

Quenching apparatus 10 has a closed quenching chamber 11 whose lower part is designed as a tank 14. Located in tank 14 is a quenching bath with a quenchant 12 in the form of an oil bath, water bath, or salt bath.

A transport device 15, which is designed in the form of a roller conveyor with rollers 16, runs transversely through quenching chamber 11. Roller conveyor 16 passes horizontally from furnace 20 through furnace outlet 22 transversely through quenching chamber 11, and continues in an outlet region 19 outside quenching chamber 11. Rollers 16 of transport device 15 serve as the support for metal workpieces 18.

Arranged in the center of quenching chamber 19, beneath transport device 15, is a duct designated overall as 25, which has an open-top duct section 24. Duct section 24 widens in its upper region and opens directly beneath rollers 16. In the quenching position shown according to FIG. 1, workpieces 18 are located above the space enclosed by open-top duct section 24. Open-top duct section 24 continues above rollers 16 in the form of a correspondingly shaped frame 34 with laterally closed valves. Frame 34 is open at the top. Frame 34 is connected, via vertical holders 35, to a hood 32 which encloses frame 34 from the outside and with its lower end extends to rollers 16 of transport device 15. Frame 34 can be moved vertically, together with hood 32, by means of a lifting apparatus 46.

In the position shown in FIG. 1, workpieces 18 have already been moved on the roller conveyor into a stipulated quenching position, and are there enclosed by frame 34, which is lowered from above while the roller conveyor is stationary. The quenching process can now begin.

For this purpose, quenching liquid is first pumped in the direction of an arrow 26 upward from below through open-top duct section 24, so that quenchant 12 floods onto workpieces 18 from below. Quenchant 12 rises inside frame 34, then emerges laterally outward over the walls of frame 34, and runs back down, inside the region surrounded by hood 32, into quenching bath 12. In FIG. 1 the quenching process has not yet begun. Liquid level 48 of quenchant 12 is in this case still below the roller conveyor, and is at the same height both inside and outside duct 25.

Figure 2:
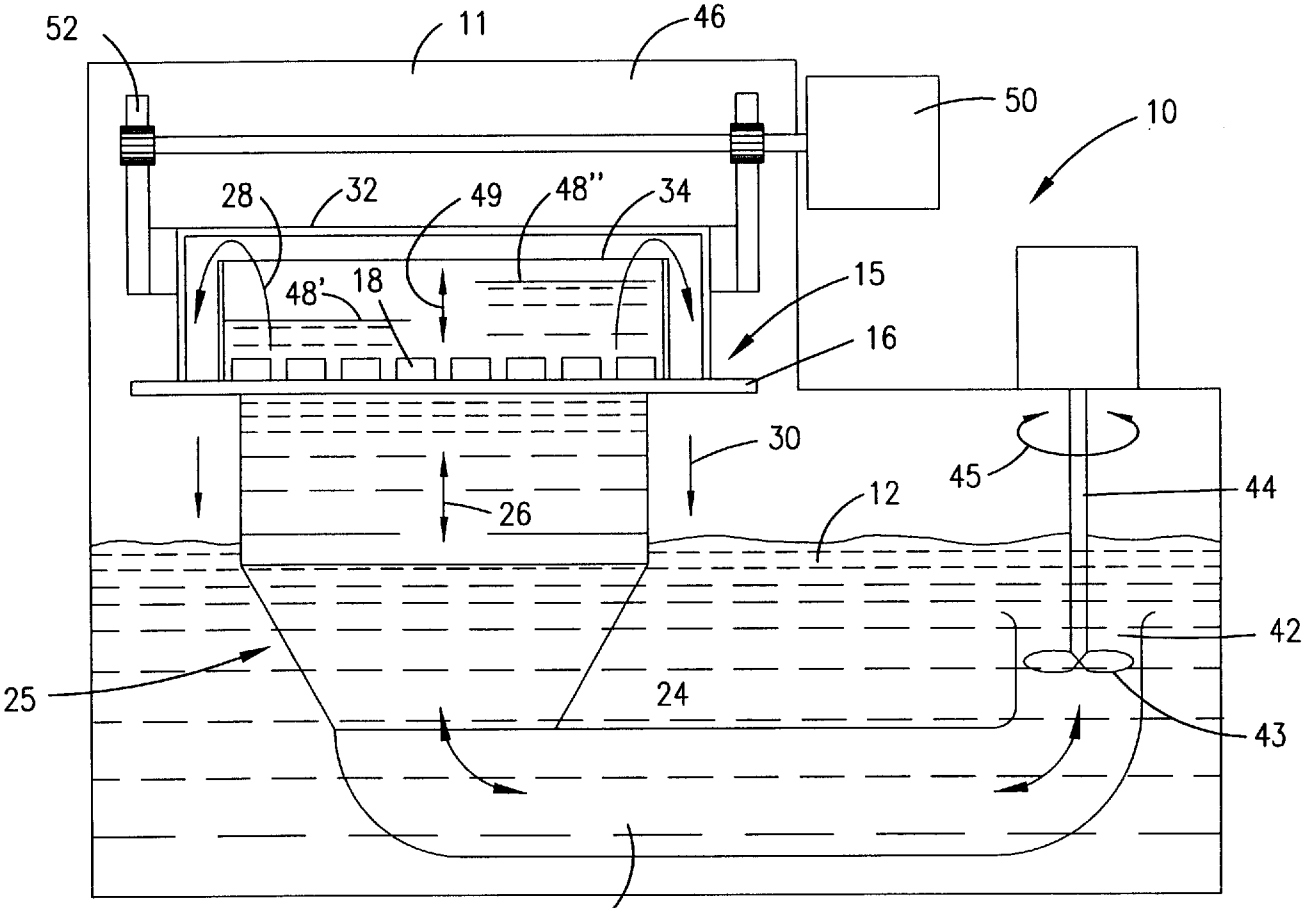
FIG. 2 shows the arrangement according to FIG. 2 in a front view.

FIG. 2 shows that quenchant 12 has already risen, inside open-top duct section 24, above rollers 16 on which workpieces 18 rest.

It is further evident from FIG. 2 that open-top duct section 24 tapers downward in its lower region and opens into a horizontal pressure tube 36 that in turn is connected to a vertical, open-top intake tube 42. A pump device 44, which projects with an impeller 43 into intake tube 42, is provided above intake tube 42.

To this extent apparatus 10 as so far described corresponds to the prior art according to the aforesaid German patent 42 18 126.

Pump device 44 is such that impeller 43 can be moved in opposite directions, as indicated by an arrow 45. Because of this, it is possible with the apparatus according to the invention to configure the flow (double arrow 26) of quenchant 12 reversingly, resulting in a liquid column in open-top duct section 24 that moves oscillatingly upward and downward.

In FIG. 2 this is indicated by the fact that above workpieces 18, a lower liquid level is drawn in in the left half with 48', and an upper liquid level in the right half with 48". The liquid column in duct section 24 oscillates between these extreme values 48' and 48", as indicated by a further arrow 29.

In this manner, flow occurs completely around workpieces 18.

A further particularity of apparatus 10 is indicated in FIG. 1. The number 55 therein designates a double arrow which is intended to illustrate that workpieces 18 can be moved on rollers 16 not only in the inherently stipulated feed direction 27, but also reversingly. For this purpose the roller train is controlled so that in the position of FIG. 1, workpieces 18 can be moved forward and backward in rapid alternation. In FIG. 1 this is further indicated with dotted lines at 18'.

Alternatively it is possible (although not depicted) also to move roller train 16 reversingly in the vertical direction or in a direction perpendicular to the drawing plane of FIG. 1, in order to produce a relative motion with respect to flow 26 of quenchant 12.

The two aforementioned possibilities for a reversing configuration of, on the one hand flow 26 of quenchant 12, and on the other hand motion 55 of workpieces 18, can be used both alternatively and together.

Figure 3:
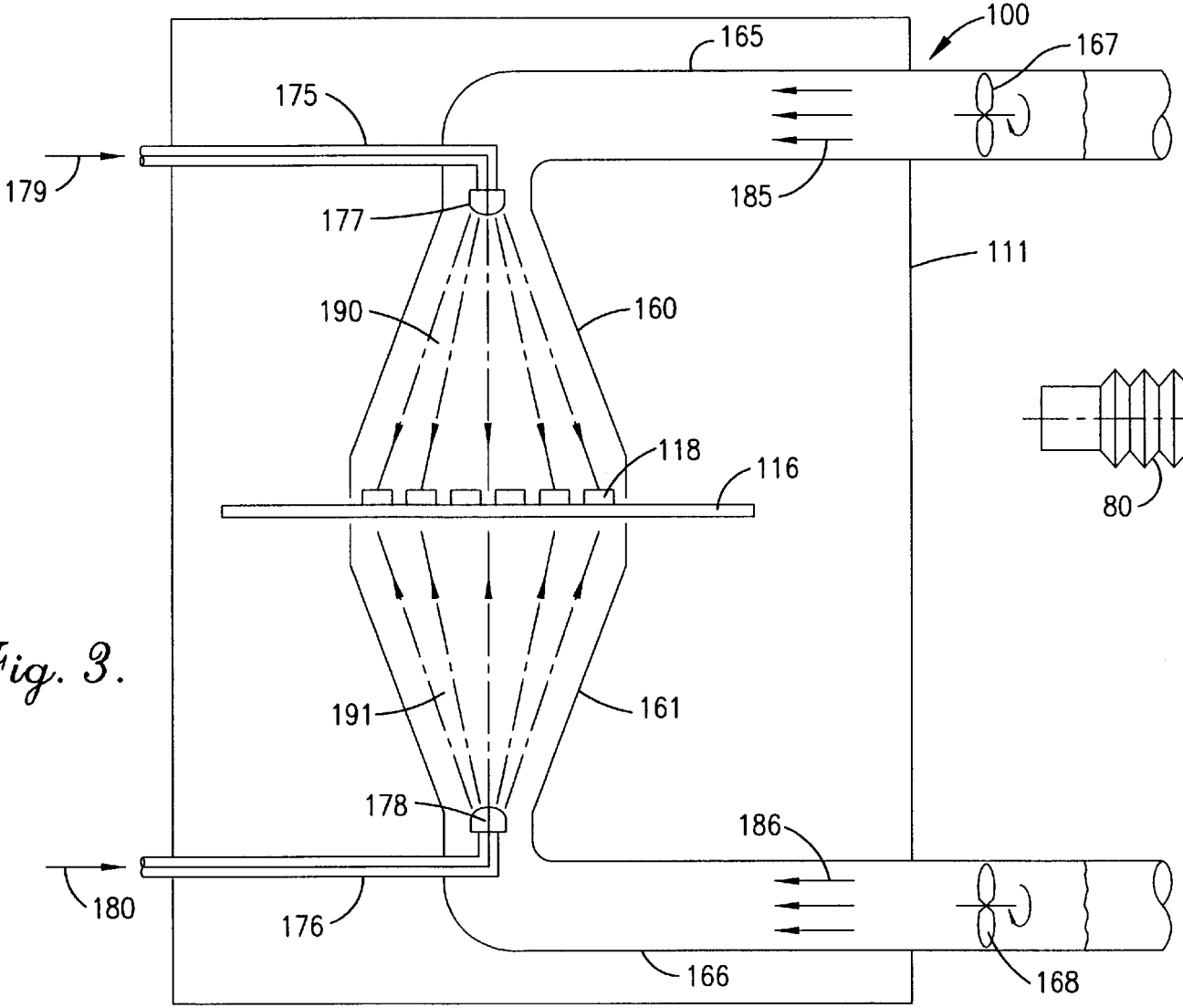
FIG. 3 shows a second exemplified embodiment of an apparatus according to the invention.

A further exemplified embodiment of the invention is depicted in FIG. 3.

A quenching apparatus 100 comprises a quenching chamber 111 through which a roller train with rollers 116 passes. Workpieces 118 are located on rollers 116.

To this extent the view in FIG. 3 corresponds analogously to that of FIG. 2 for the first exemplified embodiment described above. Workpieces 118 thus move, in the depiction of FIG. 3, perpendicular to the drawing plane.

Located respectively above and below rollers 116 are hoods 160 and 161, the open cross-sectional areas of which are delimited, in the region bordering rollers 116, in such a way that once again a predefined charge of workpieces 118 can be laterally surrounded by them.

Hoods 160, 161 are connected to pipes 165 and 166, respectively, in which fans 167 and 168, respectively, are located. Air can be taken in laterally by means of fans 167, 168, as indicated by arrows 169, 170.

Liquid lines 175, 176 open from above into hoods 160, 161 in the transition of pipes 165, 166 into hoods 160, 161. This takes place in the form of spray heads 177, 178 arranged there.

Liquid can be fed in via liquid lines 175, 176, as indicated by arrows 179, 180.

When liquid is fed in (179, 180) and air is taken in (169, 170), an air flow forms in pipes 165, 166 as indicated by arrows 185, 186. The air flow mixes, in the region of spray heads 177, 178, with the fed-in liquid, so that a mixture 190, 191 of air and liquid is sprayed and splashed from above and below onto work pieces 118.

By configuring fans 167, 168 or spray heads 177, 178 alternatingly, workpieces 118 can have mixture 190 and 191 applied onto them alternatingly from above and below.

Of course it is also possible in this instance to impart to workpieces 118, by suitable reversing of rollers 116, a motion as already described above with reference to the first exemplified embodiment.

In the exemplified embodiment according to FIG. 3, water is preferably used as the liquid; the water can also have a corrosion protection agent added to it, or can be entirely replaced by corrosion protection agent.

Instead of using air as the gas, as described, an inert gas can also be fed in via fans 167, 168.

It is preferred if mixture 190, 191 is formulated with a liquid concentration between 1 and 250 liters per square meter of workpiece surface per minute, at a gas velocity of 10 to 30 meters per second.

Figure 4:
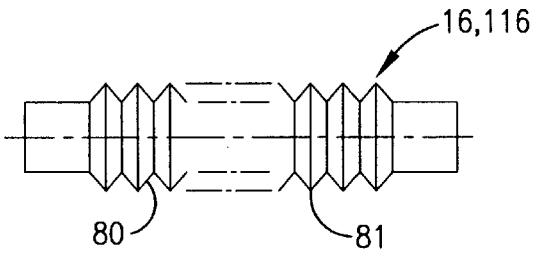
FIG. 4 shows in detail a roller for use in one of the apparatuses according to FIGS. 1 to 3.

Lastly, FIG. 4 shows another structural detail of rollers 16 or 116 that are used.

Specifically, rollers 16, 116 are equipped with circumferential constrictions 80 between which circumferential knife-edges 81 are arranged. When workpieces 18, 118 then rest on rollers 16, 116, the contact occurs at points only, since knife-edges 81 offer only a circumferential line as support.

Quenching apparatuses 10, 100 can otherwise be operated in the usual manner. For this purpose, the furnace charge, heated to hardening temperature, is moved in a rapid traverse through quenching apparatus 10, 100. In accordance with the exemplified embodiments of the invention as described, quenchant 12 is then guided in oscillating fashion past workpieces 18, 118 to be cooled down. Alternatively or simultaneously, a reversing motion of workpieces 18, 118 is performed via the roller train. Optimum distortion results for workpieces 18, 118 are achieved by the oscillating motion of quenchant 12 and/or workpieces 18, 118.

In the exemplified embodiment according to FIG. 3, the oscillating effect described is achieved via air-water mixture 190, 191, which is fed in alternatingly from the top and bottom. A reversing motion of workpieces 118 can additionally be provided here as well.

Instead of water, a quenching emulsion can also be injected into the air flow. In addition, a corrosion protection agent can be mixed into the water in order to prevent corrosion of the workpieces in the subsequent tempering process.

When a quenching emulsion is used, it is possible to displace the collapse of the vapor film (Leidenfrost temperature) toward higher temperatures. When the emulsion subsequently evaporates without residue, it is also possible to omit the washing procedure that is otherwise usual.

Depending on the application, one of the common shielding gases can also be used instead of air in order to prevent any surface oxidation. The cooling process can in any case be controlled in its intensity, as a function of material and dimensions, so that for example the inevitable wide temperature differences in the interior of the workpiece in the lower temperature range can be intercepted and compensated for.

In summary, all the prerequisites for largely distortion-free hardening are provided in this manner.

We claim:

1. A method for quenching workpieces comprising the steps of:

generating a flow of quenchant fluid, said fluid having a direction along a first axis;

cyclically inverting said direction of said flow along said first axis;

exposing said workpieces to said flow with said workpieces being moved through said flow in a direction along a second axis arranged essentially transversely to said first axis; and cyclically inverting said direction of said workpiece movement along said second axis.

2. The method of claim 1, wherein said first axis extends essentially in a vertical direction and said second axis extends essentially in a horizontal direction.

3. The method of claim 1, wherein said quenchant fluid is a liquid.

4. The method of claim 3, wherein said liquid is mixed with a gas.

5. The method of claim 4, wherein said gas is air.

6. The method of claim 4, wherein said gas is an inert gas.

7. The method of claim 3, wherein said liquid is water.

8. The method of claim 3, wherein said liquid comprises an anti-corrosive agent.

9. The method of claim 3, wherein said flow of said liquid is generated at a flow rate of between 1 and 250 liters per square meter of workpiece surface.

10. The method of claim 3, wherein said flow of said liquid is generated at a flow velocity of between 10 and 30 meters per second.

11. The method of claim 1, wherein said step of exposing comprises the sub-step of moving said workpieces through said flow on point contacts.

12. An apparatus for quenching workpieces comprising:

means for generating a flow of a quenchant fluid, said fluid having a direction along a first axis;

means for cyclically inverting said direction of said flow along said first axis;

means for exposing said workpieces to said flow with said workpieces being moved through said flow in a direction along a second axis arranged essentially transversely to said first axis; and means for cyclically inverting said direction of said workpiece movement along said second axis.

13. The apparatus of claim 12, wherein said generating means comprises a reversible pump.

14. The apparatus of claim 13, wherein said exposing means comprises a roller conveyor for moving said workpieces.

15. The apparatus of claim 14, wherein said roller conveyor is designed to support said workpieces on point contacts.

16. The apparatus of claim 15, wherein said roller conveyor comprises rollers having circumferential knife edges.

* * * * *

UNITED STATES PATENT AND TRADEMARK OFFICE
CERTIFICATE OF CORRECTION

PATENT NO. : 5,855,702

DATED : January 5, 1999

INVENTOR(S) : Guenther Disch, et al.

It is certified that error appears in the above-identified patent and that said Letters Patent is hereby corrected as shown below:

On the title page, item [73] :
Please correct Aldaichelin GmbH to ALD Aichelin GmbH.

Signed and Sealed this

Twenty-fifth Day of May, 1999

*Attest:*

Q. TODD DICKINSON

*Attesting Officer*

*Acting Commissioner of Patents and Trademarks*